United States Patent [19]

Diesch et al.

[11] 4,415,790

[45] Nov. 15, 1983

[54] MICROWAVE OVEN TEMPERATURE PROBE CONTROL

[75] Inventors: Bradford J. Diesch; Rex E. Fritts, both of Cedar Rapids, Iowa

[73] Assignee: Raytheon Company, Lexington, Mass.

[21] Appl. No.: 347,710

[22] Filed: Feb. 11, 1982

[51] Int. Cl.[3] ..... H05B 6/68

[52] U.S. Cl. ..... 219/10.55 B; 219/10.55 R; 219/499; 219/492; 323/280; 323/366; 340/588; 340/599; 374/103; 374/149

[58] Field of Search ..... 219/10.55 B, 10.55 R, 219/10.55 E, 499, 497, 492; 323/365, 366, 282, 283, 280; 374/103, 102, 149; 340/588, 589, 599

[56] References Cited

U.S. PATENT DOCUMENTS

| | | | |
|---|---|---|---|
| 3,678,247 | 7/1972 | Sawa et al. | 219/499 X |
| 3,918,636 | 11/1975 | Dawson | 219/499 X |
| 4,002,882 | 1/1977 | McCutchen | 219/499 |
| 4,117,307 | 9/1978 | Iversen et al. | 219/497 X |
| 4,217,477 | 8/1980 | Matsubara et al. | 219/10.55 B |

FOREIGN PATENT DOCUMENTS

| | | | |
|---|---|---|---|
| 2706138 | 8/1978 | Fed. Rep. of Germany | 219/492 |
| WO79/00562 | 8/1979 | PCT Int'l Appl. | 219/10.55 B |

*Primary Examiner*—B. A. Reynolds
*Assistant Examiner*—Philip H. Leung
*Attorney, Agent, or Firm*—William R. Clark; Joseph D. Pannone

[57] ABSTRACT

Control system for a microwave oven or a combination microwave and convection oven where the on time of a microwave generating system is decreased while convection heater on time may optionally be increased as a food product cooks to a predetermined, desired temperature. A temperature probe inserted in the product senses temperature and connects to a wheatstone bridge. A differential amplifier connects to the wheatstone bridge, an up/down integrator circuit connects to the differential amplifier, and a comparator connects to the integrator and which includes a latch to generate a signal to control a triac for controlling the microwave generating system and to provide a closed loop feedback signal to the temperature probe. The control system starts the oven cooking with substantially one-hundred percent power and, as the desired predetermined temperature is reached, the microwave power level is decreased through the control system. As the microwave power level is decreased, the average power to the convection heater may optionally be increased to speed the browning and crisping of a food product. The control system, through the electrical circuit, converts the temperature differential signal into a microwave generating system level signal. The closed loop feedback signal is generated by the microwave generating system which is controlled by the comparator latch and an NPN transistor controlling the up/down integrator. The control system can be used with any type of microwave oven.

17 Claims, 2 Drawing Figures

MICROWAVE OVEN TEMPERATURE PROBE CONTROL

BACKGROUND OF THE INVENTION

The process of cooking in a conventional gas or electric oven is relatively uncomplicated. Generally, temperature and time are the only two cooking parameters considered. Normally, the oven is preheated to a given temperature and the food is placed in the oven for a specified time period which is sometimes determined by the weight of the food. For example, it may be preferable to cook a turkey at 350° F. for 20 minutes per pound. Generally speaking, the heat at the surface of the food gradually travels inward by conduction raising the temperature of the interior and causing physical changes which are part of the cooking process. Because this cooking process is relatively slow and is always limited by the temperature of the oven so that there can be no thermal runaway, there is a reasonable tolerance in the selection of the cooking parameters. For example, a deviation of 10 minutes per hour or 25° F. in temperature may not have a significant impact on the palatability of the cooked food. This tolerance has contributed to a general confidence of most cooks of their ability to accurately select temperature and time, even in new situations. Another contributing factor is exposure in that most cooks grew up in homes where all of the cooking was done in conventional gas or electric ovens.

The microwave oven has evolved in the last two or three decades. Although consumer acceptance has greatly increased as has the percentage of households with microwave ovens, some consumers are still reluctant to buy or use microwave ovens because they don't have the general confidence in their ability to operate them; they feel intimidated by the sometimes complicated directions for using them. They no longer have the comfortable parameters of temperature and time to select.

The introduction or indoctrination into a relatively new cooking process is complicated by the rate at which foods cook. More specifically, because a microwave oven cooks so fast, an error of a few minutes in the selected cooking time can be a substantial percentage of the required cooking time and can result in a substantial difference in the doneness of the food. Furthermore, the temperature of the food body is not limited by the temperature of the oven; temperature runaway can occur. Accordingly, microwave oven manufacturers have expended considerable effort in research and development of apparatus and methods for simplifying the user task of determining the cooking parameters for microwave ovens. Simplified user operation would presumably expand the consumer marketplace.

One prior art approach is to provide a temperature probe which the user inserts in the food body. The oven is then permitted to remain on until the internal temperature rises to a selected value. This has been accomplished at a predetermined microwave power level set by the user. Once set, the microwave generating system operates at the chosen power level, which is reflective of a particular duty cycle for a magnetron, until the food is cooked or the power level is changed by the user. Setting the microwave power level requires a thorough knowledge of the characteristics of microwave cooking and the cooking abilities of the particular microwave oven used. There are many brands of microwave ovens with a multitude of maximum cooking powers, cooking characteristics and types of controls. All these add to the likelihood of a user error in selecting the proper power level.

The difficulty associated with the selection of the proper microwave power level is compounded by the nature of the food to be cooked and the cooking process itself. All foods are different, and they change as they cook. Different foods and different amounts of the same foods cook better at different power levels. Further, as the cooking process proceeds, the nature of the foods changes causing changes in the foods' ability to absorb the microwave energy. Hence, the optimum power level for starting the cooking process may not be the best for finishing it. Too high of a power level may overcook the food. Too low of one may undercook it or take an unnecessarily long period of time to cook the food satisfactorily.

Traditional radiant and circulated hot air ovens rely primarily on heat conduction from the surface of the food for cooking. Microwave ovens, on the other hand, generate microwave energy which penetrates the surface of the food a certain depth before being completely absorbed by the food. After that, however, even microwave ovens rely on heat conduction to cook the center of many thicker foods. In this instance in particular, there is a distinct possibility that the surface of the food may overcook before the center is cooked or the center may be left undercooked to preserve the appearance and quality of the surface of the food.

If the surface of the food, in the case of some foods, and the center of the food, in the case of other foods, could be held at a desired temperature, the cooking process could proceed while minimizing the possibility of overcooking or undercooking. The present invention accomplishes that while eliminating the possibility of user error in setting the power level by automatically reducing the microwave power level as the temperature of the food rises. At the same time, the power not consumed by the microwave generating system may be utilized by a radiant or forced hot air heater to increase the browning and crisping as the food reaches the desired degree of doneness.

SUMMARY OF THE INVENTION

The present invention is a microwave oven that automatically controls the duty cycle and hence the time average power level of the microwave generating system to quickly heat a food with microwave energy and then to reduce the average amount of microwave energy in response to a temperature rise in the food. Simultaneously, the energy diverted from the microwave generating system may be utilized by an electric heater to enhance the browning and crisping of the food. The oven includes an electrical circuit that converts a temperature differential signal into a signal for controlling the power level of the microwave generating system. The purpose is to decrease the microwave power level through the control system from substantially full power to a lesser amount of power thereby minimizing cooking time and precisely cooking the food product.

According to one embodiment of the present invention, there is provided a control system for a microwave oven, including a microwave generating system, a switching means connected to the microwave generating system, a temperature sensing probe for sensing temperature of a food product being heated in the microwave oven, a wheatstone bridge for generating a temperature differential signal and having one leg of the wheatstone bridge connected to the temperature probe and an opposing leg connected to a temperature set resistor, a differential amplifier for amplifying the temperature differential signal and connected to the opposing legs of the wheatstone bridge, and an operational amplifier for integrating and generating a control signal through a latch and comparator. The control signal connects to the switching means of the microwave generating system to minimize cooking time and precisely cook the food product. The operational amplifier includes circuitry permitting it to positively and negatively integrate on a set wave form for controlling on/-off time of the microwave generating system. Once the comparator reaches the set temperature, the comparator locks onto the upward portion of the set wave form and the latch resets on the downward portion of the set wave form. The circuit also includes an NPN transistor connected to an inverting input of the integrator circuitry for resetting the integrator of the set wave form. The reset signal is provided through a circuit connected to the base of the NPN transistor.

The percentage of cooking power may be varied as a function of the sensed probe temperature where the temperature is set by a standard resistance in the wheatstone bridge, the maximum temperature which the food will be allowed to reach. The maximum temperature excursion desired is such that the power varies from substantially 100% to 0% over the temperature as set by the set resistor in the wheatstone bridge where the set resistor may be a temperature dial on the front panel of the microwave oven. Equations implement a curve where the equilibrium temperature may be approximated as a point on the curve as a function of percentage power versus probe temperature over the set temperature in the wheatstone bridge.

One significant aspect and feature of the present invention is a control circuit which automatically controls the power setting of the microwave generating system from substantially full power down to an equilibrium percentage of power for an equilibrium temperature. As the desired, predetermined temperature is reached, the power level is decreased through the control system thereby optimizing the cooking time and precisely controlling the cooking of the food product.

Another significant aspect and feature of the present invention is a microwave oven control system electrical circuit which generates a temperature differential signal through a temperature probe connected in as one leg of a wheatstone bridge. The temperature differential signal is converted into a microwave generating system level signal for controlling the switching circuitry connected to the microwave generating system. The switching circuitry generates full microwave power to a decreasing amount once a predetermined equilibrium temperature is reached which may be determined by equations representing the curve of percentage microwave power versus temperature. The equations are a function of the percentage power versus the sensed probe temperature over the set temperature in two legs of the wheatstone bridge.

Another significant aspect and feature of the present invention is a control system which includes an electrical circuit having an up/down integrator in one circuit to positively and negatively integrate on a set wave form for actuating a comparator network with a latch. The system also operates with a signal for resetting the up/down integrator.

Having thus summarized the invention, it is one principal object hereof to provide a control system for a microwave oven or a microwave convection oven.

Another object of the present invention is to provide a control system having an electrical circuit in which an operator may preset the final temperature for a food product. The circuit energizes the microwave generating system at substantially full power and, as the predetermined temperature is approached, the power level is decreased so as not to overcook the food with the microwave energy. This provides for efficient use of microwave power by minimizing cooking time and thereby minimizing consumption of energy. At the same time, operator errors in setting the power level are eliminated.

Another object of the present invention is to provide a control system for a microwave convection oven where the on time of the microwave power source is decreased while the convection heater on time is substantially increased as a food product reaches a predetermined temperature as sensed by the temperature probe in the food product in the cavity of the microwave oven.

A further object of the present invention is to provide a control system which automatically decreases the microwave power level from 100% to 0%, all the while searching for the given food's equilibrium power level as approximated on the cooking curve. Consequently, it is not necessary to preset any power levels as in microwave ovens currently being sold in the marketplace. This provides for operator ease in operation of the microwave oven or microwave convection oven, whichever oven the operator uses.

BRIEF DESCRIPTION OF THE DRAWING

Other objects and many of the attendant advantages of this invention will be more readily appreciated as the same becomes better understood by reference to the following detailed description when considered in connection with the accompanying drawings, in which like reference numerals designate like parts and wherein.

DESCRIPTION OF PREFERRED EMBODIMENTS

Figure 1:
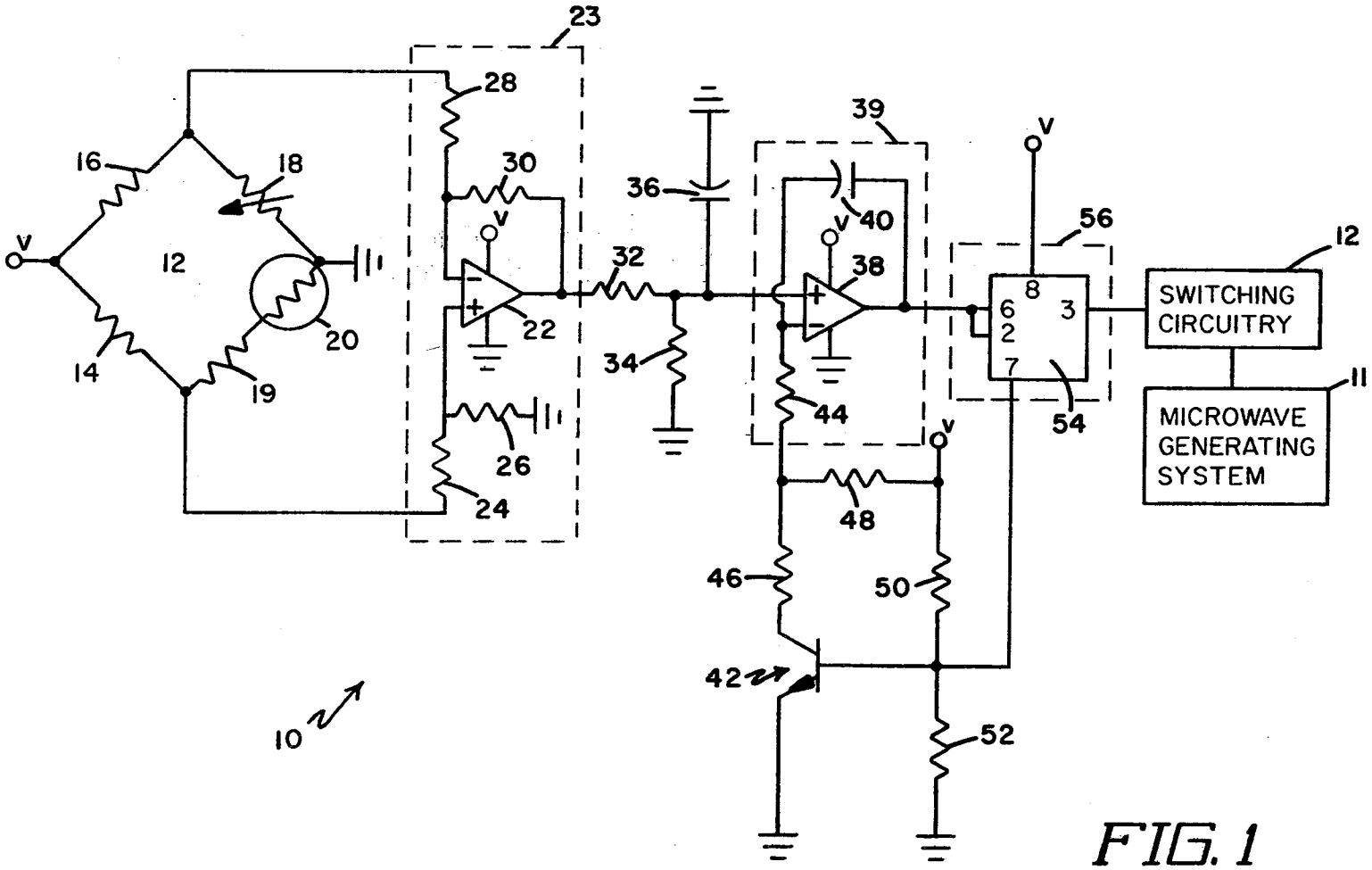
FIG. 1 illustrates an electrical circuit schematic diagram of a control system for a microwave oven.

FIG. 1 illustrates an electrical circuit schematic diagram of a control system 10 for a microwave generating system 11 for controlling microwave power. It shows a temperature probe resistor 20 which is incorporated into a temperature probe and positioned in a microwave oven cavity in any of a number of ways well known in the art. Resistor 20 is connected in a wheatstone bridge circuit 12. The wheatstone bridge circuit 12 includes fixed resistors 14 and 16, a set resistor 18 such as variable potentiometer and temperature probe resistor 20 in series with biasing resistor 19. Temperature probe resistor 20 is adapted for insertion into a food product as well known in the art. Voltage source V connects to the junction of resistors 14 and 16. Operational amplifier 22 connects to the opposing junctions of the wheatstone bridge 12 through resistors 24 and 28. Feedback resistor 30 is connected across the op amp 22 to form a differential amplifier 23. Resistors 24, 26, 28 and 30 establish an amplification factor through op amp 22. Resistors 32 and 34 connect to the output of the op amp 22 to form a voltage divider circuit. Capacitor 36 is connected to the output of the op amp 22 to act as a filter and remove any stray radio frequency current present in the control system 10.

Integrated circuit 38 with connected circuitry forms an up/down integrator 39. The up/down integration times of integrator 39 are set by the voltage at the non-inverting terminal of integrator IC 38. The output of the up/down integrator IC 38 connects to time 56. Timer 56 comprises a fixed period, variable duty cycle, square wave oscillator made up of an astable multivibrator built around "555" monlithic timer IC 54 with connections wired to pins 2 and 6. The remainder of the connections to IC 54 to complete timer 56 are well known in the art. One example is that shown and described in prior filed, commonly owned U.S. patent application Ser. No. 105,084 U.S. Pat. No. 4,332,992 which is hereby incorporated by reference. Other examples are shown in issued U.S. Pat. Nos. 4,121,079 and 4,242,554 which are also hereby incorporated by reference.

IC 38, which connects between resistor 32 and pins 2 and 6 of the 555 timer 56, together with capacitor 40 connected between the output and inverting input of IC 38 and with resistor 44 form the up/down integrator circuitry 39. Resistors 50 and 52 bias the base of transistor 42 which connects to pin 7 of the integrated circuit 54. The emitter of the transistor 42 connects to ground, and the collector of transistor 42 connects to the inverting input of integrator IC 38 through resistors 44 and 46. Resistor 48 connects between the V voltage source and the node of the resistors 44 and 46 for collector biasing and biasing of the inverting input of IC 38.

Transistor 42 forms a circuit between the timer integrated circuit 54 and the inverting input of the up/down integrator IC 38. The feedback signal through the transistor 42 of the closed loop feedback circuit provides for utilization of the IC 38 as an up/down integrator and controls the integration (positive or negative) depending upon the biasing of the base of the transistor 42. In this circuit, timer 56 acts as a comparator exhibiting hystersis with a latched output through transistor 42.

In operation, the food product is inserted into the cavity of the microwave oven for cooking in a microwave or a combination microwave and convection cooking mode. Resistor 18 is set with the aid of a scale, not shown, corresponding to degrees of temperature conveniently located on the front panel of the microwave oven in a manner well known in the art. The resistor 20 of the temperature probe is inserted into the food product in the cavity and appropriately connected to the control circuitry such as by plugging a probe plug on the other end of the temperature probe into a socket in the wall of the cavity as well known in the art.

If the resistor 20 is not at the same resistance as the set resistor 18 corresponding to the predetermined preset temperature, a voltage difference is created across the wheatstone bridge 12 in the normal manner. The voltage difference is amplified by the differential amplifier 23 since voltage on the non-inverting terminal is higher than the inverting terminal. This causes the output of the differential amplifier 23 to go positive by an amount proportional to the voltage difference generated by the bridge. This positive voltage output is divided by resistors 32 and 34, filtered by capacitor 36 and connected to the non-inverting input to IC 38.

Integrator 39 integrates on the signal appearing at the non-inverting input in a manner to be explained and, on reaching a voltage of two-thirds of the value of the voltage of pin 8 of timer 56, the output of pin 3 of timer 56 goes low, energizing the switching circuity 12 in a manner further explained in the patents and patent application already incorporated by reference. The switching circuitry, in turn, is connected to microwave generating system 11 in any number of ways well known in the art. At the same time, pin 7 of timer 56 goes to ground, turning off transistor 42. With transistor 42 turned off, voltage V is applied to the inverting terminal of IC 38 through resistors 44 and 48. This causes the integrator 39 to start to negatively integrate. When the voltage on pins 2 and 6 of the timer 54 reaches one-third of the value of the voltage on pin 8 of timer 56, the output of pin 3 goes high, and pin 7 goes to an open circuit.

By pin 7 giving an open circuit, it is effectively removed from the circuit. With the base transistor 42 no longer grounded, it begins to conduct through the current provided to its base from voltage source V through resistor 50. The base of transistor 42 is biased through resistors 50 and 52. The conduction of transistor 42 causes a voltage drop through resistors 48 and 46 to ground. The values of resistors 46, 48, 50 and 52 are selected such that transistor 42 continues to conduct and the positive voltage at the node between resistors 46 and 48 is dropped sufficiently so that, with the additional voltage drop through resistor 44, the voltage appearing at the inverting input of up/down integrator 39 is now less than that at the non-inverting input. Hence, the integrator will begin to integrate again, and the loop is complete.

The switching action of the transistor 42 controls the up/down integrating of the integrator 39. The cycling time of integrator 39 is determined by the voltage on the non-inverting terminal where the voltage is set by differential amplifier 23 which is the amplified voltage differential across the wheatstone bridge 12. The amplification factor of the differential amplifier 23 is high, such as one thousand. It is determined by resistors 24, 26, 28 and 30 by techniques well known in the art. Similarly, the capacitive value of integrating capacitor 39 controls the rate at which IC 38 integrates in a manner well known in the art.

The positive output voltage signal from differential amplifier 23 generally decreases with time. This is because as the object to be cooked is heated, it, in turn, heats temperature probe resistor 20. As it heats, resistive value of resistor 20 drops, causing a lesser voltage difference at the inputs to differential amplifier 23 to be amplified. Thus, the system reacts to heating in the food or other object to be heated by providing an input to the non-inverting input to up/down integrator 39 of lesser positive voltage. A lesser positive voltage at the non-inverting input means that it will take longer for integrator 39 to reach two-thirds of the value of the voltage of pin 8 of timer 56. The longer that takes, the longer pin 3 stays high and the microwave generating system 11 remains de-energized. Hence, over time, the microwave generating system 11 is energized less and less as the object to be heated reaches the desired temperature.

Figure 2:
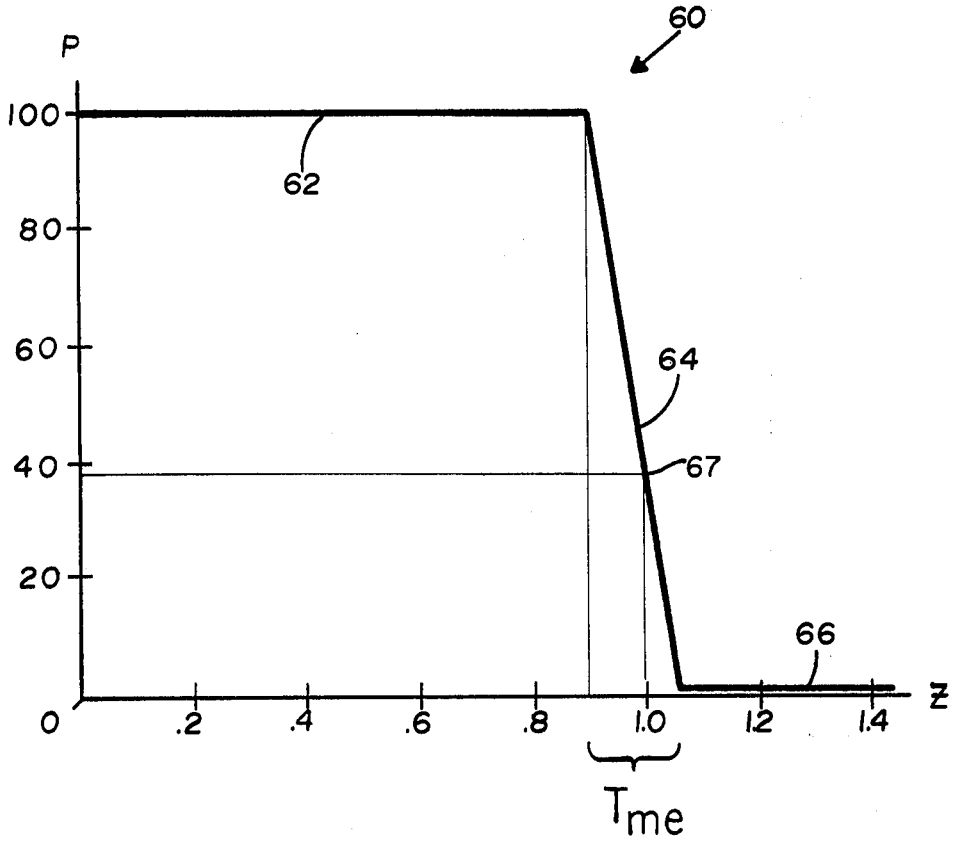
FIG. 2 illustrates a piecewise linear curve of cooking power versus sensed probe temperature over preset temperature.

FIG. 2 illustrates a plot 60 of cooking power, "P," versus sensed probe temperature, "Tp," over preset temperature, "Ts," which is defined by equations 1–3 below. The percentage cooking power as a function of the sensed probe temperature over a preset temperature is approximated as a linear function with a decreasing ramp. With the percent power indicated on the vertical axis and the sensed probe temperature over a preset temperature set on the horizontal axis, the maximum temperature excursion, "Tme," can be determined as a function of the percent power varying from 100% to 0%. The horizontal straight line with a ramp can be described by the equation where $$P = \frac{100Tm}{Tme}\left(\frac{Tm + Tme/2}{Tm} - Z\right), \quad \text{for } \frac{Tm - Tme/2}{Tm} < Z < \frac{Tm + Tme/2}{Tm}; \tag{1}$$

$$P = 100 \text{ for } Z < \frac{Tm - Tme/2}{Tm}; \tag{2}$$

$$P = 0 \text{ for } Z > \frac{Tm + Tme/2}{Tm}; \text{ and} \tag{3}$$

$Tp$ = sensed probe temperature;
$Ts$ = temperature as set by resistor 18;
$Tm$ = maximum temperature the probe resistor 20 is expected to sense;
$Tme$ = maximum temperature excursion desired such that $P$ varies from 100 to 0;
$Z = Tp/Ts$; and,
$P$ = percent time average microwave power.

The relationship of equations 1—3 describes the graphical representation of FIG. 2. Equation 1 represents the slope segment and equations 2 and 3 represent the substantially full power and zero power segments respectively. The representation of FIG. 2 is a straight line approximation of what in reality may more nearly approach a decreasing exponential curve. In other words, the function of the circuit of FIG. 1 is best illustrated by the three segment 62, 64 and 66—piecewise linear approximation of a decreasing exponential curve of FIG. 2. Because of the amplification factor of the IC differential amplifier 23, the curve which is approximated as a straight line has a very sharp slope. As the predetermined desired temperature is reached, the magnetron duty cycle is decreased. By cutting back on the power level, no manual setting of power is required, and the food is not overcooked. Also, the cooking time is shorter than with conventional microwave oven circuits in convection microwave ovens. For foods that require a reduced average power level, this invention determines the most efficient cooking curve and thus provides optimum cooking in the minimum time. The control circuit automatically starts out cooking the food product with substantially 100% power at line segment 62, then decreases the magnetron "on" time in line segment 64 as the desired temperature is reached until an equilibrium power level is achieved, as best illustrated at point 67. If the initial temperature of the food is higher than the desired temperature, the control circuit starts out at 0% power at line segment 66. As the food cools, the magnetron "on" time is increased until the desired temperature is reached at point 67.

Various modifications of the present invention can be made without departing from the apparent scope thereof. The circuit 10 of FIG. 1 can be easily implemented in any microwave or microwave convection oven. A suitable switch can be installed to switch between the circuitry 10 of FIG. 1 and microwave oven circuitry which may include power level settings. The power level setting circuits are not applicable with the circuit 10 of FIG. 1 and would have to be disabled in any number of conventional manners during utilization of the circuit of FIG. 1.

Having described the invention, what is claimed is:

1. A microwave oven comprising:

a microwave generating system;

means for switching said microwave generating system on and off;

means for providing a first signal derived from the temperature of an object placed in said oven, said providing means comprising means for sensing the temperature of an object and means responsive to said sensing means for generating said first signal, said temperature sensing means comprising a resistive temperature probe, said first signal generating means comprising a wheatstone bridge circuit having a first leg comprised of two fixed resistors connected in series and a second leg comprised of a set resistor and said resistive temperature probe connected in series, said first signal generating means further comprising a differential amplifier connected to the node between said fixed resistors and the node between said set resistor and said resistive temperature probe;

means for automatically controlling said switching means in response to said first signal to decrease the power level of said microwave generating system to an equilibrium power level wherein the temperature of said object is held at a predetermined level, said switch controlling means comprising means for providing a second signal derived from said first signal, said switch controlling means further comprising means for periodically energizing said switching means in response to said second signal, said switch controlling means further comprising means for controlling said second signal providing means with said periodic switch energizing means, said second signal providing means comprising an up/down integrator connected to said differential amplifier output, said periodic switch energizing means comprising a comparators exhibiting hysteresis connected to said up/down integrator output and having a latched output connected to an input to said up/down integrator, said second signal providing controlling means comprising a feedback transistor connected between said comparator latch output and the input to said up/down integrator.

2. A control system for a microwave oven having a microwave generating system and a switching means connected to said microwave generating system, said control system comprising:

means for sensing the temperature of a product being heated in said oven;

means connected to said sensing means for generating a temperature differential signal;

means for amplifying said differential signal;

means for integrating said amplified temperature differential signal and generating a control signal connected to said switching means to control the operation of said microwave generating system, said integrating means comprising a positive integrating means and a negative integrating means for positively and negatively integrating on a set waveform;

means for feeding back to said positive and said negative integrating means for resetting said positive and said negative integrating means;

means for presetting a predetermined temperature calibrated in degrees through a variable resistor; and means for comparing and latching connected between said integrating means and said switching means.

3. The control system of claim 2 wherein said sensing means comprises a resistive temperature probe positioned in said product.

4. The control system of claim 3 wherein said temperature differential signal generating means comprises a wheatstone bridge whereby differences in resistance between said preset temperature resistor and said resistive temperature probe generate said temperature differential signal.

5. The control system of claim 4 wherein said amplifying means comprises a differential amplifier.

6. The control system of claim 5 wherein said amplifying means has an amplification factor of approximately 1,000.

7. The control system of claim 6 wherein said integrating means comprises an operational amplifier.

8. The control system of claim 7 wherein said means for comparing and latching comprises one integrated circuit.

9. The control system of claim 8 wherein said feedback means connects between said comparator-latch means and said integrating means for resetting said integrating means.

10. The control system of claim 9 wherein said feedback means comprises an NPN transistor.

11. The control system of claim 10 wherein the microwave power output of said microwave generating system is a function of sensed probe temperature over said present resistance temperature and wherein $$P = \frac{100Tm}{Tme}\left(\frac{Tm + Tme/2}{Tm} - Z\right), \quad \text{for } \frac{Tm - Tme/2}{Tm} < Z < \frac{Tm + Tme/2}{Tm}; \tag{1}$$

$$P = 100 \text{ for } Z < \frac{Tm - Tme/2}{Tm}; \tag{2}$$

$$P = 0 \text{ for } Z > \frac{Tm + Tme/2}{Tm}; \text{ and} \tag{3}$$

$Tp$ = sensed probe temperature;
$Ts$ = temperature as set by resistor 18;
$Tm$ = maximum temperature the probe resistor 20 is expected to sense;
$Tme$ = maximum temperature excursion desired such that $P$ varies from 100 to 0;
$Z = Tp/Ts$; and,
$P$ = percent average microwave power.

12. A microwave oven, including a microwave generating system and a switching means connected to the microwave generating system, comprising:

a. a microwave oven cavity selectively associated with the microwave generating system;

b. a wheatstone bridge having fixed resistors in upper legs, a variable resistor selectively associated with a temperature selection dial in one lower leg, and a temperature resistive probe in the other lower leg;

c. a differential amplifier connected across the wheatstone bridge for amplifying a signal difference generated across the bridge;

d. an up/down integrator having a non-inverting input connected to the output of the differential amplifier;

e. a comparator latch connected to the output of the up/down integrator; and, f. a transistor connected between the comparator latch and an inverting terminal of the up/down integrator whereby the transistor controls up/down integrating on a set wave form with a closed loop feedback signal thereby decreasing the microwave generating system on time through the comparator latch, from substantially 100% power to substantially temperature maintaining power as the temperature probe resistance reaches a set resistance.

13. A microwave convection oven, including a microwave generating system, a thermal generating means, a switching means connected between the microwave generating system and the thermal generating means, and a switching means connected to the microwave generating system, comprising:

a. a microwave oven cavity selectively associated with the microwave generating system;

b. a wheatstone bridge having fixed resistors in upper legs, a variable resistor selectively associated with a temperature selection dial in one lower leg, and a temperature resistive probe in the other lower leg;

c. a differential amplifier connected across the wheatstone bridge for amplifying a signal difference generated across the bridge;

d. an up/down integrator having a non-inverting input connected to the output of the differential amplifier;

e. a comparator latch connected to the output of the up/down integrator; and, f. a transistor connected between the comparator latch and an inverting terminal of the up/down integrator whereby the transistor controls up/down integrating on a set wave form with a closed loop feedback signal from the comparator latch thereby decreasing the microwave generating system on time through the comparator latch from substantially 100% power to substantially temperature maintenance equilibrium power as the temperature probe resistance reaches a set resistance.

14. The oven recited in claim 13 wherein the differential amplifier comprises a gain factor of substantially 1000.

15. The oven recited in claim 14 wherein the up/down integrator comprises an operational amplifier.

16. The oven recited in claim 15 wherein the comparator latch comprises a 555 timer circuit.

17. The oven recited in claim 16 wherein the microwave power output of said microwave generating system is a function of a sensed probe temperature over the preset resistance temperature and wherein $$P = \frac{100Tm}{Tme}\left(\frac{Tm + Tme/2}{Tm} - Z\right), \quad \text{for } \frac{Tm - Tme/2}{Tm} < Z < \frac{Tm + Tme/2}{Tm}; \tag{1}$$

$$P = 100 \text{ for } Z < \frac{Tm - Tme/2}{Tm};$$

$$P = 0 \text{ for } Z > \frac{Tm + Tme/2}{Tm}; \text{ and}$$

-continued $Tp$ = sensed probe temperature;

$Ts$ = temperature as set by resistor 18;

$Tm$ = maximum temperature the probe resistor 20 is expected to sense;

$Tme$ = maximum temperature excursion desired such that $P$ varies from 100 to 0;

$Z = Tp/Ts$; and, $P$ = percent average microwave power.

* * * * *